United States Patent [19]

Kurachi et al.

[11] Patent Number: 4,959,526

[45] Date of Patent: Sep. 25, 1990

[54] STORAGE TYPE ELECTRIC WATER HEATER HAVING A CLOSED CIRCULATION LOOP WITH A BUBBLE PUMP

[75] Inventors: Yasuhiko Kurachi, Aichi; Kazumi Mori, Okazaki; Hisao Koizumi, Zushi, all of Japan

[73] Assignees: Chubu Electric Power Company, Inc., Nagoya; Kabushiki Kaisha Toshiba, Kawasaki, both of Japan

[21] Appl. No.: 247,274

[22] Filed: Sep. 21, 1988

Related U.S. Application Data

[63] Continuation-in-part of Ser. No. 69,229, Jul. 2, 1987, Pat. No. 4,818,845.

[30] Foreign Application Priority Data

Jul. 3, 1986 [JP] Japan ..... 61-154978
Sep. 21, 1987 [JP] Japan ..... 62-236859

[51] Int. Cl.[5] ..... H05B 1/02; F24H 1/10; F24H 1/18

[52] U.S. Cl. ..... 219/314; 126/362; 219/297; 219/301; 219/302; 219/334; 417/208

[58] Field of Search ..... 219/296–309, 219/310, 312, 314, 316, 320, 321; 126/362, 361, 351; 417/207–209

[56] References Cited

U.S. PATENT DOCUMENTS

| | | | |
|---|---|---|---|
| 978,808 | 12/1910 | Ayer | 219/301 |
| 1,389,166 | 8/1921 | Scott | 219/301 X |
| 1,670,506 | 5/1928 | Johnson | 219/306 |
| 1,671,584 | 5/1928 | Hicks et al. | 219/321 X |
| 1,717,207 | 6/1929 | Halle | 219/314 |
| 1,809,077 | 6/1931 | Shuman | 219/306 X |
| 1,837,597 | 12/1931 | Thomas | 219/314 X |
| 1,977,156 | 10/1934 | Staley | 219/306 |
| 1,994,765 | 3/1935 | Harvey | 219/301 |
| 2,026,809 | 1/1936 | Winn | 219/306 X |
| 2,105,893 | 1/1938 | Salmonsen | 219/297 |
| 2,440,610 | 4/1948 | Kimberlin | 219/208 |
| 2,462,746 | 2/1949 | Inman | 219/306 X |
| 2,519,920 | 8/1950 | Miner | 219/301 |
| 3,247,359 | 4/1966 | Feld | 219/306 X |
| 3,400,246 | 9/1968 | Zob | 219/297 |

FOREIGN PATENT DOCUMENTS

| | | | |
|---|---|---|---|
| 86530 | 9/1920 | Switzerland | 219/306 |
| 1028398 | 5/1966 | United Kingdom | 219/301 |

*Primary Examiner*—Anthony Bartis
*Attorney, Agent, or Firm*—Oblon, Spivak, McClelland, Maier & Neustadt

[57] ABSTRACT

A hot water boiling apparatus includes a hot water tank filled with water. A water supply pipe and a hot water supply pipe are connected to the bottom and top of the tank, respectively. A bubble pump unit is arranged in parallel with the tank. The pump unit includes a body having a boiling chamber, electric heaters for heating the water in the chamber, a first connecting pipe for guiding water from the tank to the body, a guide pipe for feeding the water, guided through the first connecting pipe, into the boiling chamber, and a second connecting pipe for guiding the water heated in the boiling chamber into the upper portion in the tank. The guide pipe is arranged so that heat is exchanged between the water in the boiling chamber and the water flowing through the guide pipe.

21 Claims, 7 Drawing Sheets

STORAGE TYPE ELECTRIC WATER HEATER HAVING A CLOSED CIRCULATION LOOP WITH A BUBBLE PUMP

CROSS-REFERENCE TO THE RELATED APPLICATION

This is a continuation-in-part application of U.S. patent application Ser. No. 069,229, filed July 2, 1987 and now U.S. Pat. No. 4,818,845.

BACKGROUND OF THE INVENTION

1. Field of the Invention

The present invention relates to a hot water boiling apparatus of a storage type, using an electric heater as its heat source.

2. Description of the Related Art

Hot water boiling apparatuses using an electric heater as their heat source are classified into two types; an instant type and a storage type. The instant type is constructed so that water is instantaneously heated to a predetermined temperature by means of a large-capacity electric heater, to be supplied as hot water. The storage type is designed so that hot water of a predetermined temperature is previously stored in a hot water tank, and is supplied as required. Normally, the instant-type boiling apparatuses cannot produce hot water of a satisfactory temperature unless they use an electric heater with a large capacity of 5 to 20 kw. Therefore, the storage-type boiling apparatuses are exclusively put to household use.

Usually, the storage-type hot water boiling apparatuses comprise a hot water tank covered with a heat insulator. The lower portion of the inside of the tank is connected to a water supply pipe, while the upper portion is connected to a tap by means of a hot water supply pipe. A sheath-type electric heater is located in the lower portion of the hot water tank. The heater is supplied with electric power to heat all the water in the tank to, for example, 80° C. during a time zone in which hot water need not be used, e.g., at midnight. There are two systems for supplying power to the heater; a full time power supply system and an off-peak power supply system. According to the full-time system, the power supply to the heater is started at any point of time, and is stopped when all the water in the tank attains a predetermined temperature. According to the late-night power supply system, the power supply to the heater is started at midnight during which the electric charges are relatively small, and is stopped when all the water in the tank attains a predetermined temperature. From the economical point of view, the late-night power supply system is used more widely. This system is provided with a timer switch which starts operation when the predetermined time is reached every day, for example, whereby the power supply to the electric heater is controlled. The timer switch is under the control of an electric power supplier, and is not accessible to users.

However, these hot water boiling apparatuses are subject to the following drawbacks, which will be described in connection with an apparatus using the all-time power supply system. When the electric heater is energized, the water in the hot water tank is gradually heated by a natural convection. At this time, the speed at which the water temperature rises depends on the capacities of the heater and the tank. It is hard, however, to incorporate a large-capacity electric heater in an apparatus for household use. In order to fulfill its function as a storage-type version, the apparatus must use a hot water tank with a capacity of at least several hundreds of liters. Accordingly, the speed at which the water temperature in the tank rises is not very great. When all the water in the tank is heated to 80° C., for example, the power supply to the heater is stopped. Thus, in the hot water boiling apparatus using the all-time power supply system, it takes much time to heat the water in the tank to the proper temperature for use, i.e., 80° C. Moreover, all the water in the hot water tank would be heated to the set temperature of 80° C. without regard to the quantity of hot water actually required. Therefore, if the necessary quantity of hot water on the day and the capacity of the tank are 100 l and 300 l, respectively, energy will be wastefully consumed to heat 200 l of excessive water to 80° C. This also applies to the case of the late-night power supply system. In a hot water boiling apparatus using the late-night power supply system, the power supply is allowed only during the limited time zone. To avoid a shortage of hot water supply in the daytime, therefore, the hot water tank must have a large capacity. Thus, the boiling apparatus requires a wider installation space, and may possibly waste electric power at a higher rate. In the conventional hot water boiling apparatus based on the late-night power supply system, moreover, hot water of 80° C. is stored in the hot water tank at midnight. During the daytime, therefore, the hot water can be used at once as long as it is in the tank. In case of shortage, however, no hot water can be used in the daytime.

SUMMARY OF THE INVENTION

The present invention has been contrived in consideration of these circumstances, and its object is to provide a hot water boiling apparatus capable of rapidly supplying a hot water without using a large-capacity heater.

In order to achieve the above object, a hot water boiling apparatus according to the present invention comprises: a hot water tank having an upper end formed with a hot water supply port and a lower end formed with a water supply port, the tank containing water therein; a hot water supply pipe connected to the hot water supply port, for feeding the hot water in the tank to the outside thereof; water supply means connected to the water supply port, for feeding water into the hot water tank; and bubble pump means for feeding hot water into the upper portion of the hot water tank after sucking the water from the lower portion of the inside of the tank and heating the sucked water, the pump means including a body having a boiling chamber, heating means for heating water in the boiling chamber, a first connecting pipe for guiding the water from the lower portion of the hot water tank to the body, a guide pipe for feeding the water, guided through the first connecting pipe, into the boiling chamber, a second connecting pipe for guiding the water heated in the boiling chamber into the upper portion of the hot water tank, and regulating means for allowing the water to flow only from the lower portion of the hot water tank toward the upper portion thereof, the guide pipe being arranged so that heat is exchanged between the water in the boiling chamber and the water flowing through the guide pipe.

BRIEF DESCRIPTION OF THE DRAWINGS

FIGS. 1 to 8 show a hot water boiling apparatus according to an embodiment of the present invention, in which FIG. 1 is a sectional view showing an outline of the apparatus, FIG. 2 is an enlarged sectional view of a bubble pump, FIG. 3 is a schematic view of a power supply system of the apparatus, FIGS. 5 and 6 are a schematic view of the bubble pump and a graph, respectively, for illustrating the relation between the temperature changes of inflow water and outflow water in the bubble pump, FIG. 7 is an oscillogram showing the relation between the respective temperatures of the inflow water and the outflow water in the bubble pump, and FIG. 8 is a graph for comparing the temperature change characteristics of the outflow water of the bubble pump according to the first embodiment and the outflow water of another bubble pump; and FIGS. 9 and 10 show a bubble pump according to another embodiment of the present invention, in which FIG. 9 is a longitudinal sectional view, and FIG. 10 is a cross-sectional view taken along line X—X of FIG. 9.

DETAILED DESCRIPTION OF THE PREFERRED EMBODIMENTS

A hot water boiling apparatus according to an embodiment of the present invention will now be described in detail with reference to the accompanying drawings of FIGS. 1 to 8.

Figure 1:
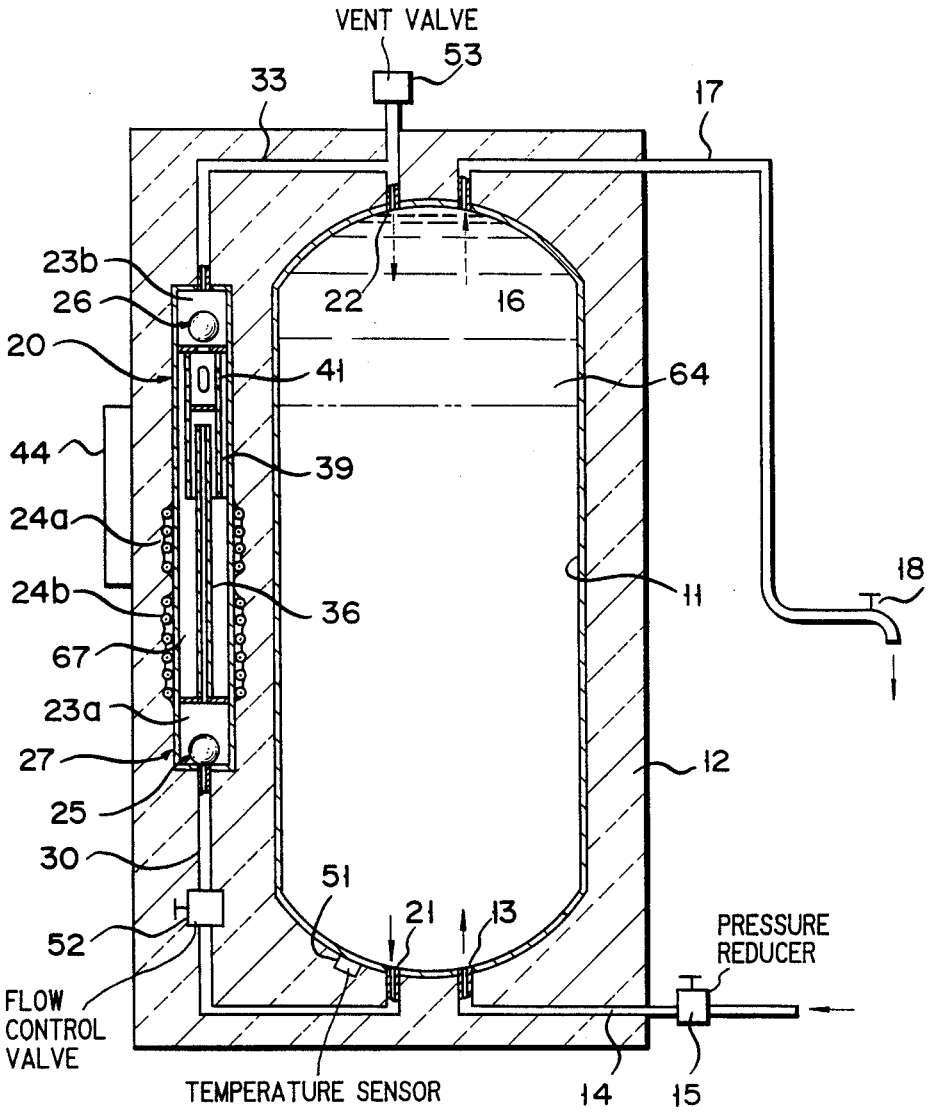

As is shown in FIG. 1, the hot water boiling apparatus comprises substantially cylindrical hot water tank 11 closed at both ends and extending substantially in the vertical direction. Tank 11 is covered with heat-insulating structure 12.

Water supply port 13 is formed in the bottom wall of hot water tank 11, and one end of water supply pipe 14 is connected to port 13. The other end of pipe 14 is connected to a water source (not shown), e.g., tap water. Pressure reducing valve 15 is provided in the middle of pipe 14. It serves to reduce the pressure of water introduced through pipe 14 into tank 11 to 1 kg/cm$^2$ or less. The top wall of tank 11 is formed with hot water supply port 16 through which hot water in the tank is discharged to the outside. Port 16 is connected, by means of hot water supply pipe 17, to tap 18 in a kitchen, bathroom, or the like. Normally, tank 11 is filled with water, and is subjected to the pressure of water fed through pipe 14. Thus, when tap 18 is turned on, the water in tank 11 is discharged to the outside through supply port 16 and supply pipe 17.

Figure 2:
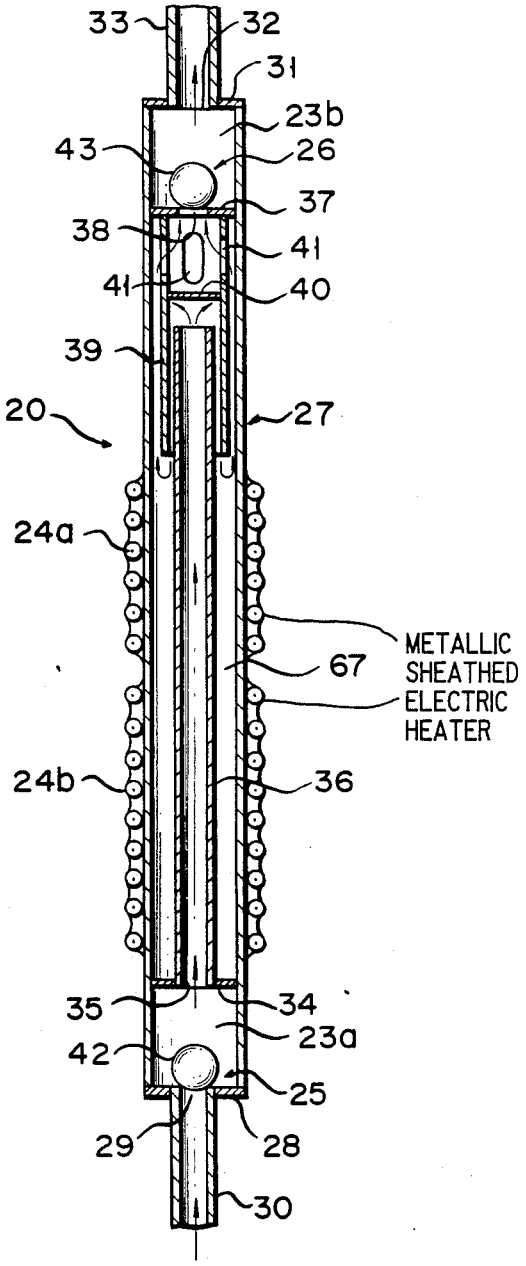
Figure 3:
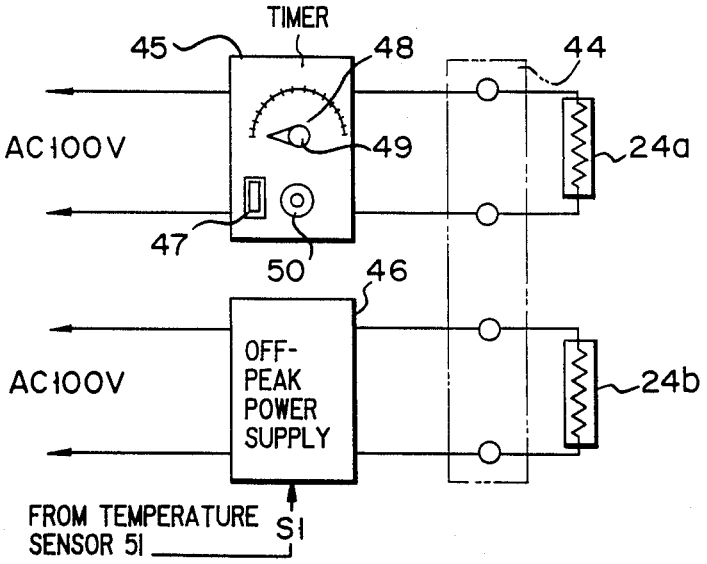

Bubble pump unit 20 is embedded in heat-insulating structure 12, extending parallel to hot water tank 11. As is shown in FIGS. 1 and 2, pump unit 20 includes pump body 27 which extends vertically. The pump body, which is made of copper or aluminum, is in the form of a cylinder having a thickness of 1.5 mm, inner diameter of 34 mm, and length of 70 mm, for example. Openings at the upper and lower ends of pump body 27 are closed by upper and lower closing walls 31 and 28, respectively. Lower closing wall 28 is formed with inlet port 29, which is connected to suction port 21 in the bottom wall of tank 11 by means of first connecting pipe 30. Upper closing wall 31 is formed with outlet port 32, which is connected to discharge port 22 in the top wall of tank 11 by means of second connecting pipe 33. Thus, tank 11, pipe 30, pump body 27, and pipe 33 constitute a closed loop through which water flows.

Inside pump body 27, first and second partition plates 34 and 37 are arranged facing lower and upper closing walls 28 and 31, respectively. The inside of body 27 is divided into three chambers by plates 34 and 37. These chambers include lower valve chamber 23*a* defined between wall 28 and plate 34, upper valve chamber 23*b* defined between wall 31 and plate 37, and boiling chamber 67 defined between plates 34 and 37. Inside the boiling chamber, first guide pipe 36, which is formed of a stainless-steel pipe with an outer diameter of 14 mm, for example, is arranged coaxially with pump body 27. The lower end of guide pipe 36 is connected, in a liquid-tight manner, to aperture 35 formed in first partition plate 34, while the upper end of pipe 36 extends close to second partition plate 37. Thus, the water guided from hot water tank 11 to lower valve chamber 23*a* through first connecting pipe 30 flows through guide pipe 36, and is fed into boiling chamber 67 via an upper end opening or discharge port of pipe 36. Inside the boiling chamber, moreover, second guide pipe 39, which is formed of a stainless-steel pipe, is arranged coaxially with first guide pipe 36. Pipe 39 has an outer diameter smaller than the inner diameter of pump body 27 and an inner diameter greater than the outer diameter of pipe 36. The upper end of pipe 39 is fixed to the lower surface of second partition plate 37, and communicates with aperture 38 in plate 37. The lower end of pipe 39 extends to the position where it overlaps the upper end portion of pipe 36. Thus, the upper end portion of first guide pipe 36 is inserted in the lower end portion of second guide pipe 39. Inside the second guide pipe, third partition plate 40 is fixed facing the upper end of pipe 36. A plurality of communication holes 41 are bored through that portion of the peripheral wall of pipe 39 which is situated between second and third partition plates 37 and 40. Thus, the water discharged from the discharge port of pipe 36 passes between the outer peripheral surface of pipe 36 and the inner peripheral surface of pipe 39, and flows into boiling chamber 67. The water in boiling chamber 67 flows between the outer peripheral surface of second guide pipe 39 and the inner peripheral surface of pump body 27, and is guided into hot water tank 11 via communication holes 41, aperture 38, upper valve chamber 23*b*, and second connecting pipe 33.

Check valves 25 and 26 are provided in lower and upper valve chambers 23*a* and 23*b*, respectively. Valve 25 is composed of a valve seat, formed of the peripheral edge of aperture 29, and heat-resistant plastic ball 42 located in chamber 23*a* to cooperate with the value seat. Valve 25 allows the water to flow only from first connecting pipe 30 toward pump body 27. Likewise, valve 26 is composed of a valve seat, formed of the peripheral edge of aperture 38, and heat-resistant plastic ball 43 located in chamber 23*b* to cooperate with the valve seat. Valve 26 allows the water to flow only from body 27 toward second connecting pipe 33.

Bubble pump unit 20 is provided with first and second sheath-type electric heaters 24*a* and 24*b* which serve as heating means for heating the water in boiling chamber 67. Heaters 24*a* and 24*b*, which have outputs of, e.g., 2 kw and 4 kw, respectively, are wound around those regions of the outer peripheral surface of pump body 27 between first partition plate 34 and the lower end of second guide pipe 39, and are fixed by brazing.

Terminal box 44 is fixed to the outer surface of heat-insulating structure 12. First and second heaters 24a and 24b are connected, respectively, to power supply systems 45 and 46 shown in FIG. 3 through the terminal box. System 45 is designed so as to selectively excite heater 24a by using a commercial power source. More specifically, system 45 is constructed so that if pushbutton switch 50 is depressed after turning knob 49 of timer switch 48 for delayed action, with manual switch 47 on, heater 24a can be supplied with power for a period of time set by means of the timer switch. System 46 is a late-night power supply system which allows a discount on electric charges. More specifically, system 46 is a combination of a timer and switches, and is adapted to start power supply to electric heater 24b at a scheduled time, e.g., at 11 p.m., every day. Further, system 46 is constructed so as to receive output S1 from temperature sensor 51, which is attached to the lower portion of hot water tank 11, and to stop the power supply to heater 24b when the temperature of the water in the lower portion of tank 11 increases to, e.g., 80° C. In FIG. 1, numerals 52 and 53 designate a flow regulating valve and a conventional float-type vent valve, respectively.

The following is a description of the operation and application of the hot water boiling apparatus constructed as aforesaid.

Let it first be supposed that hot water tank 11 is filled with low-temperature water, and that tap 18 is off. In this state, there is no water flow at all, so that both check valves 25 and 26 are closed, and bubble pump unit 20 is filled with low-temperature water.

Figure 4A:
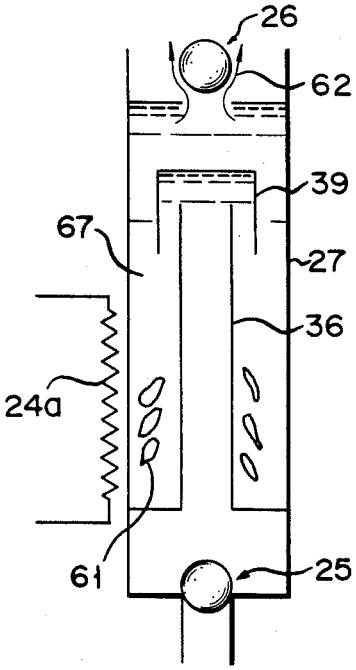
FIGS. 4A and 4B are schematic views showing different operating states of the bubble pump.
Figure 4B:
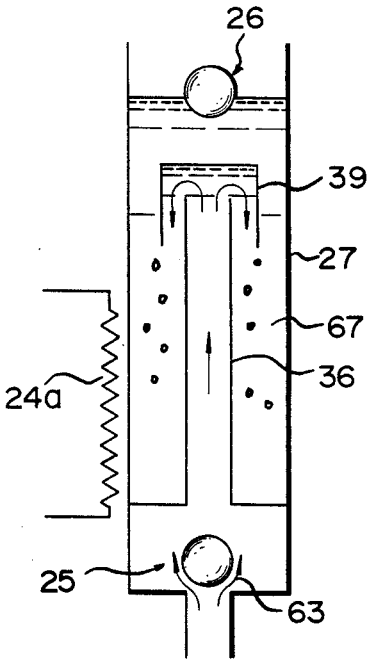

In this state, knob 49 of timer switch 48 is operated to set a desired time limit. Then, switch 47 is turned on, and push-button switch 50 is depressed. Thereupon, power supply to electric heater 24a is started. When heater 24a starts to be supplied with power that portion of the water in boiling chamber 67 which is in contact with the inner surface of pump body 27 inside heater 24a is heated quickly. When the temperature of part of the water in chamber 67 attains the boiling point, steam bubbles 61 are produced as is shown in FIG. 4A. As a result, the water rapidly increases its volume, thereby raising the pressure inside boiling chamber 67. Thereupon, check valve 26 is opened, so that boiling water is fed from pump body 27 into second connecting pipe 33, as indicated by solid-line arrows 62 in FIG. 4A. When bubbles 61 rise by buoyancy to reach the level of the lower end portion of second guide pipe 39, they are cooled and condensed by relatively cold water in the vicinity of the lower end portion of pipe 39. As a result, the pressure inside chamber 67 is lowered. Thereupon, check valves 26 and 25 are closed and opened, respectively, as is shown in FIG. 4B, so that the cold water in the lower portion of hot water tank 11 flows into boiling chamber 67 through first connecting pipe 30 and guide pipes 36 and 39. Accordingly, the temperature of the water in chamber 67 further lowers, so that bubbles 61 quickly disappear. Thereupon, the water ceases to flow in through pipe 30. Thus, the temperature of the water in chamber 67 starts to increase again, so that bubbles 61 are produced again. Thereafter, the aforementioned operations are repeated within the time limit set by means of timer switch 48. In this manner, hot water of e.g. 80° C. is intermittently discharged from pump body 27.

The discharged hot water is passed through second connecting pipe 33 to be fed into the upper portion of hot water tank 11 via discharge port 22. Thus, 80° C. hot water 64 is collected in a thermally stratified manner in tank 11, as is shown in FIG. 1. The thickness of the thermal layer can be set freely by changing the conduction time of electric heater 24a, i.e., the time limit set by means of timer switch 48. In the case described above, hot water is stored as required by the use of power supply system 45. In this embodiment, however, system 46 is provided as a late-night power supply system, which automatically supplies power to electric heater 24b at 11 p.m. Thus, 80° C. hot water is collected in hot water tank 11 in the same manner as aforesaid.

Figure 5:
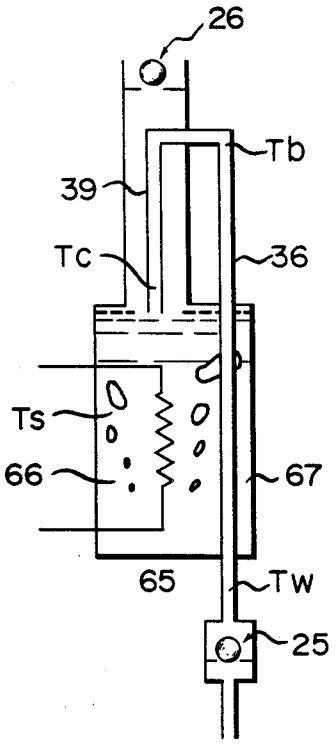

According to the hot water boiling apparatus having bubble pump unit 20 constructed in this manner, even though the temperature of the water supplied to hot water tank 11 through water supply pipe 14 varies depending on the season or the like, variation of the temperature of the hot water delivered from pump unit 20 can be made relatively small, and the breaking sound of the bubbles can be reduced. More specifically, water is supplied to boiling chamber 67 of pump unit 20 via first guide pipe 36 and the space between first and second guide pipes 36 and 39. All these pipes have thermal conductivity. FIG. 5 simulatively shows the flows of water and heat in pump unit 20. While water of temperature Tw supplied from first connecting pipe 30 rises in first guide pipe 36, it exchanges heat with water 66 in boiling chamber 67 boiling at temperature Ts under heat from electric heater 65, thereby increasing its temperature to Tb. Thereafter, as the water of temperature Tb lowers between first and second guide pipes 36 and 39, it exchanges heat with water of temperature Ts rising from chamber 67, thereby increasing its temperature to Tc. Then, water of temperature Th, which is lower than Ts, is delivered from upper check valve 26.

Figure 6:
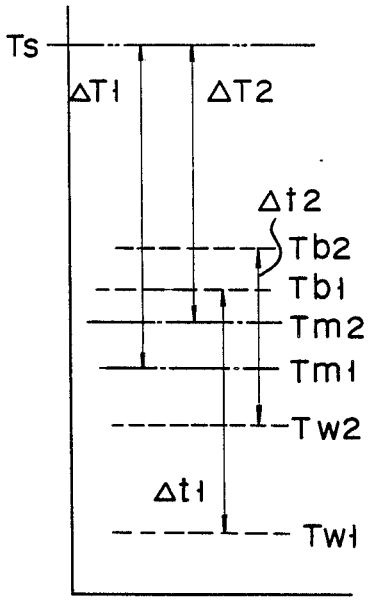

Referring now to FIG. 6, let us consider two cases in which feed water temperature Tw is Tw1 and Tw2 ($Tw1<Tw2$).

If temperature Tb is Tb1 and Tb2 when the feed water temperature is Tw1 and Tw2, respectively, mean temperatures Tm1 and Tm2 are given by $$Tm1=(Tw1+Tb1)/2, \quad (1)$$

$$Tm2=(Tw2+Tb2)/2, \quad (2)$$

Suppose we have $Tb1-Tw1=\Delta t1$, $Tb2-Tw2=\Delta t2$, $Ts-Tm1=\Delta T1$, and $Ts-Tm2=\Delta T2$. If the quantity of water flowing through first guide pipe 36 and the heat conductivity of pipe 36 are constant, and if amount Q of heat transferred from water 66 in boiling chamber 67 to the water in pipe 36 via the wall of pipe 36 is $Q=k\Delta T$, the amounts of heat transfer for the two cases are $$qC\Delta t1=k\Delta T1, \quad (3)$$

$$qC\Delta t2=k\Delta T2, \quad (4)$$

where q is the flow rate (kg/s) of inside first guide pipe 36, and c is the specific heat (J/kg·°C.) of water.

Substituting equations (1) and (2) from equations (3) and (4), we obtain $$qC(Tb1-Tw1)=k\{Ts-(Tw1+Tb1)/2\}, \quad (5)$$

$$qC(Tb2-Tw2)=k\{Ts-(Tw2+Tb2)/2\}. \quad (6)$$

From equations (1), (2), (3), and (4), therefore, we obtain $$Tb2-Tb1=(B/A)(Tw2-Tw1), \quad (7)$$

where (B/A) equals $\{(\Delta t1-1)/2\}/\{(\Delta t1=1)/2\}$, and is smaller than 1. If the feed water temperature changes from Tw1 to Tw2, therefore, the change (Tb2−Tb1) of Tb is smaller than (Tw2−Tw1). Thus, if the feed water temperature changes, the variation of the temperature of the water supplied to boiling chamber 67 of bubble pump unit 20 is smaller than the variation of the feed water temperature, so that the temperature of hot water delivered from the pump unit can be stabilized. In the present embodiment, second guide pipe 39 is used in combination with first guide pipe 36. Thus, while the water supplied through pipe 36 descends within pipe 39, it exchanges heat with a rising flow of hot water around pipe 39 in boiling chamber 67, thereby further increasing its temperature to Tc. Meanwhile, the rising hot water is cooled to temperature Th, and discharged from chamber 67. As compared with the example described in connection with equation (7), therefore, the influence of the feed water temperature upon the temperature of the hot water delivered from pump unit 20 is less, so that the delivered hot water temperature can be further stabilized.

Moreover, the water preheated by heat exchange is fed into boiling chamber 67 of bubble pump unit 20, as mentioned before. The cooling capacity of the preheated water is less than that of unheated water, and its bubble condensing capability is less. Accordingly, the bubbles produced in chamber 67 are condensed more slowly by the preheated water, so that the breaking sound of the bubbles is lower, that is, production of noises can be restrained.

Thus, the hot water boiling apparatus is improved in handling efficiency, and the degree of freedom of the installation site is upped.

Figure 7:
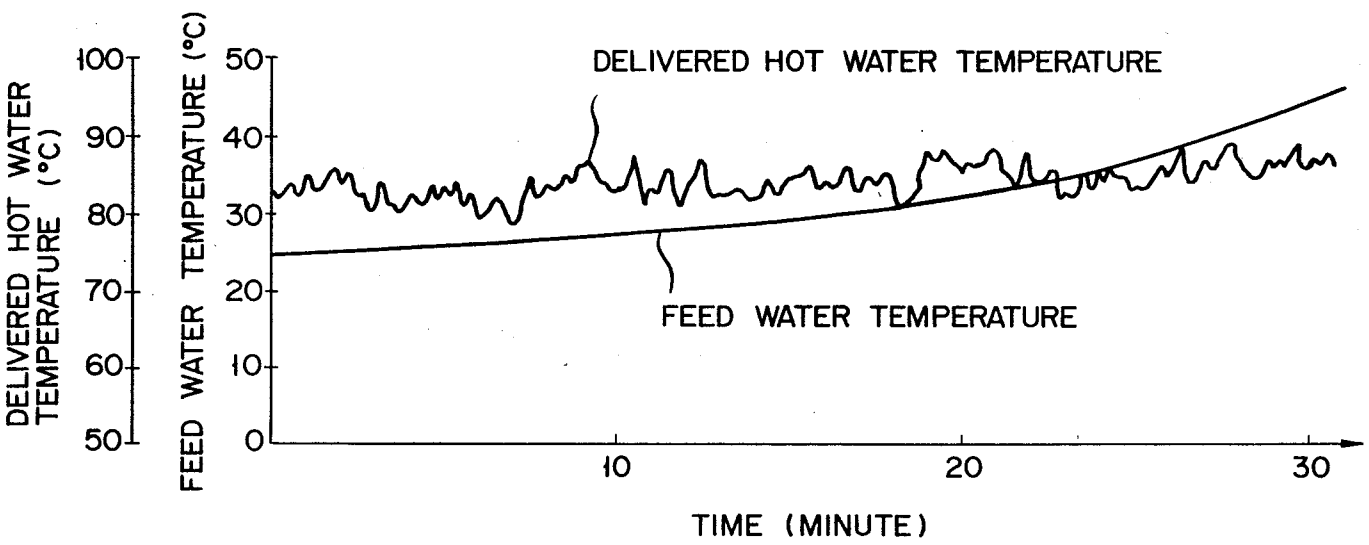
Figure 8:
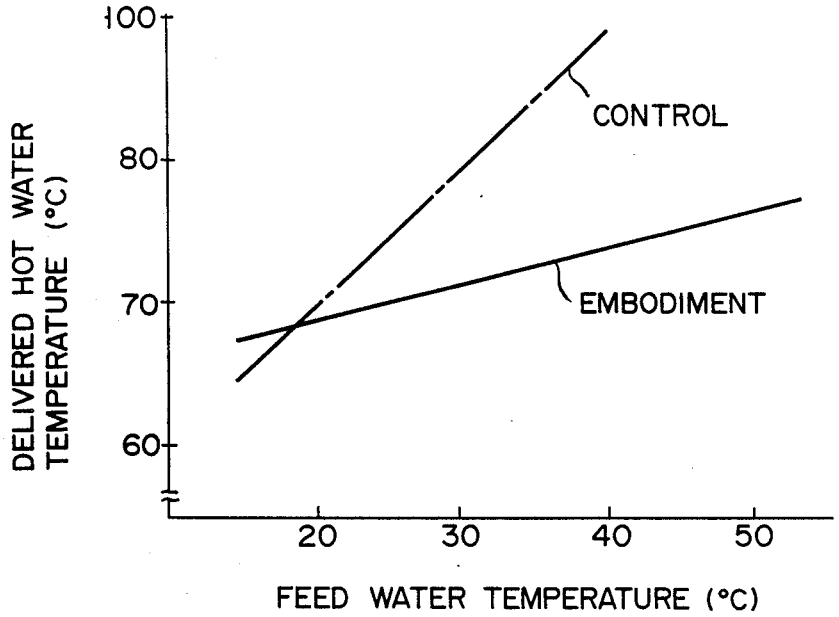

FIG. 7 is an oscillogram showing a result of a test on a bubble pump with the same construction as the aforementioned embodiment, made on an experimental basis. In FIG. 7, the axis of abscissa represents the time elapsed after the start of power supply to the electric heater. Although the feed water temperature changes from 25° C. to 45° C., the delivered hot water temperature hardly changes. FIG. 8 shows the test result of FIG. 7 compared with that of another bubble pump. In FIG. 8, the full-line represents the delivered hot water characteristic of the bubble pump unit according to the present embodiment, while the dashed-line represents a delivered hot water characteristic obtained if first and second guide pipes 36 and 39 are removed from the pump of the embodiment, and when water is fed into boiling chamber 67 without being preheated. According to the present embodiment, as seen from FIG. 8, the variation of the delivered hot water temperature can be made much smaller than that of the feed water temperature.

It is to be understood that the present invention is not limited to the embodiment described above, and that various changes and modifications may be effected therein by one skilled in the art without departing from the scope or spirit of the invention.

According to the aforementioned embodiment, a pair of independent electric heaters are provided; one for an all-time power supply system, and the other for a late-night power supply system. Alternatively, however, only one electric heater may be used so that electric power is supplied only from either the full-time power supply system or the late-night power supply system. The power supply system is selected in consideration of the difference in electric charges according to time zone, conditions of domestic use of hot water, etc. Also, the arrangement of the bubble pump unit may be changed as required.

Figure 9:
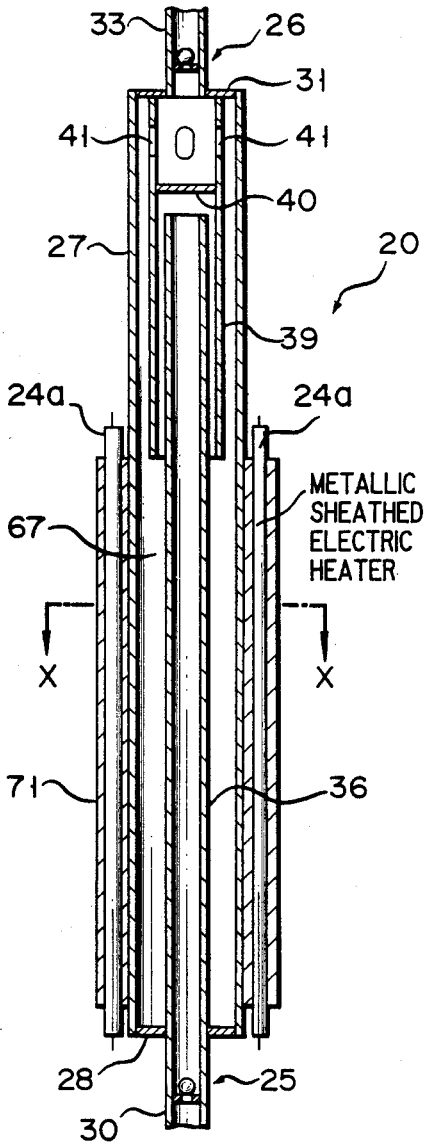
Figure 10:
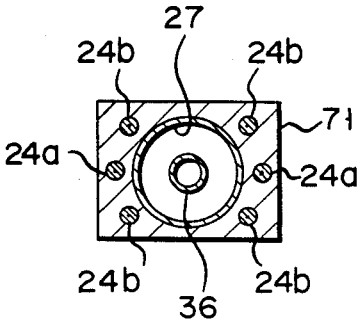

FIGS. 9 and 10 show bubble pump unit 20 according to a second embodiment of the present invention. In this pump unit, hollow aluminum block 71 is fixed on the outer peripheral surface of pump body 27, and sheath-type electric heaters *24a* and *24b* are embedded in the block so as to extend parallel to body 27. According to this second embodiment, moreover, check valves 25 and 26 are disposed in first and second connecting pipes 30 and 33, respectively. In this case, the distal end portion of pipe 30 extends through lower closing wall 28 of pump body 27 into boiling chamber 67, thus constituting first guide pipe 36.

In the first and second embodiments described above, the second guide pipe may be omitted. Also in this case, the variation of the delivered hot water temperature, attributable to the change of the feed water temperature, can be made smaller than in the case of an apparatus without first guide pipe 36. For the check valves, moreover, flap valves may be used in place of ball valves. For the flow regulating function, furthermore, a throttle pipe may be used in place of the flow regulating valve in the first connecting pipe. The flow regulating valve and throttle pipe may be omitted. The material for first and second guide pipes 36 and 39 may be changed, depending on the variation of the target temperature of the delivered hot water or the like.

What is claimed is:

1. A hot water boiling apparatus comprising:

a hot water tank having an upper end formed with a hot water supply port and a lower end formed with a water supply port, said tank containing water therein;

a hot water supply pipe connected to the hot water supply port, for discharging the hot water from the tank to the outside;

water supply means connected to the water supply port, for feeding water into the hot water tank; and bubble pump means arranged external of said hot water tank, for feeding hot water into the upper portion of the hot water tank after sucking the water from the lower portion of the inside of the tank and heating the sucked water, said pump means including a body having a boiling chamber, heating means for heating water in the boiling chamber and generating steam bubbles in the water, a first connecting pipe for guiding the water from the lower portion in the hot water tank to the body, a guide pipe for feeding the water, guided through the first connecting pipe, into the boiling chamber and condensing said steam bubbles by the water fed through the guide pipe, a second connecting pipe for guiding the water heated in the boiling chamber into the upper portion in the hot water tank, and first and second regulating means arranged in the first and second connecting pipes, for allowing the water to flow only from the lower portion of the hot water tank toward the upper portion thereof, said guide pipe being so arranged with respect to said pump means body that heat is exchanged between the water in the boiling chamber and the water flowing through the guide pipe to preheat the water prior to entry thereof into the boiling chamber.

2. An apparatus according to claim 1, wherein said guide pipe is arranged in the boiling chamber, and has a lower end communicating with the first connecting pipe and an upper end opening into the boiling chamber.

3. An apparatus according to claim 2, wherein said boiling chamber has an upper end communicating with the second connecting pipe and a lower end located close to the first connecting pipe, and extends substantially vertically, and said guide pipe extends inside the boiling chamber in the axial direction thereof, the upper end of the guide pipe being situated close to the upper end of the boiling chamber.

4. An apparatus according to claim 3, wherein said boiling chamber is cylindrical, and said guide pipe is coaxial with the boiling chamber.

5. An apparatus according to claim 3, wherein said bubble pump means includes a second guide pipe for guiding the water discharged from the upper end of the first guide pipe toward the lower end of the boiling chamber, said second guide pipe being arranged so that heat is exchanged between the water flowing through the second guide pipe and the water in the boiling chamber.

6. An apparatus according to claim 5, wherein said second guide pipe has an inner diameter greater than the outer diameter of the first guide pipe, and is located in the boiling chamber so as to cover the upper end portion of the first guide pipe and be coaxial with the first guide pipe, said second guide pipe further having a lower end opening toward the lower end of the boiling chamber and a partition plate facing the upper end of the first guide pipe, whereby the water discharged from the upper end of the first guide pipe is passed between the outer peripheral surface of the first guide pipe and the inner peripheral surface of the second guide pipe to be guided downward.

7. An apparatus according to claim 1, wherein said pump means body is in the form of a cylinder whose inner peripheral surface defines the boiling chamber, and said heating means includes first and second electric heaters provided on the outer peripheral surface of the pump body.

8. An apparatus according to claim 7, wherein said heating means includes first power supply means for energizing the first electric heater in a predetermined manner, and second power supply means for energizing the second electric heater in a desired manner.

9. An apparatus according to claim 8, wherein said second power supply means includes a timer circuit for optionally setting the conduction duration and conduction start time for the second electric heater.

10. An apparatus according to claim 8, wherein said first power supply means includes a sensor for detecting the temperature of the water in that region of the hot water tank near the water supply port, so that power supply to the first electric heater is started at a predetermined point of time, and is stopped when the water temperature detected by the sensor attains a predetermined temperature level.

11. An apparatus according to claim 7, wherein said first and second electric heaters are fixedly wound around the outer peripheral surface of the pump means body.

12. An apparatus according to claim 7, wherein said first and second electric heaters are each formed of rod-shaped sheath heater extending parallel to the pump means body.

13. An apparatus according to claim 1, wherein said first regulating means includes a first check valve for allowing the water to flow only from the first connecting pipe toward the pump body, and said second regulating means includes a second check valve for allowing the water to flow only from the pump body toward the second connecting pipe.

14. An apparatus according to claim 13, wherein said first and second check valves are arranged in the first and second connecting pipes, respectively.

15. An apparatus according to claim 13, wherein said pump body includes a first valve chamber located between the first connecting pipe and the guide pipe, and a second valve chamber located between the second connecting pipe and the boiling chamber, said first and second check valves being arranged in the first and second valve chambers, respectively.

16. An apparatus according to claim 1, which further comprises heat insulating means covering the tank, and wherein said bubble pump means is embedded in the heat insulating means.

17. The hot water boiling apparatus of claim 1 wherein said guide pipe comprises means for feeding all of the water guided through the first connecting pipe into the boiling chamber.

18. A hot water boiling apparatus comprising:

a hot water tank having an upper end formed with a hot water supply port and a lower end formed with a water supply port, said tank containing water therein;

a hot water supply pipe connected to the hot water supply port, for discharging the hot water from the tank to the outside;

water supply means connected to the water supply port, for feeding water into the hot water tank; and bubble pump means arranged external of said hot water tank, for feeding hot water into the upper portion of the hot water tank after sucking the water from the lower portion of the inside of the tank and heating the sucked water, said pump means including a body defining a boiling chamber having upper and lower ends, heating means arranged around the pump means body, for heating water in the boiling chamber and generating steam bubbles in the water, a first connecting pipe for guiding the water from the lower portion in the hot water tank to the body, a guide pipe arranged in the boiling chamber, for feeding the water, guided through the first connecting pipe, into the boiling chamber and condensing said steam bubbles by the water fed through the guide pipe, said guide pipe having a lower end connected to the first connecting pipe and an upper end which opens into the boiling chamber and located near the upper end of the boiling chamber, a second connecting pipe for guiding the water heated in the boiling chamber into the upper portion in the hot water tank, and first and second regulating means arranged in the first and second connecting pipes, for allowing the water to flow only from the lower portion of the hot water tank toward the upper portion thereof, said guide pipe being arranged so that heat is exchanged between the water in the boiling chamber and the water flowing through the guide pipe to preheat the water prior to entry thereof into the boiling chamber.

19. The hot water boiling apparatus of claim 18 wherein said guide pipe comprises means for feeding all of the water guided through the first connecting pipe into the boiling chamber.

20. A hot water boiling apparatus comprising:

a hot water tank having an upper end formed with a hot water supply port and a lower end formed with a water supply port, said tank containing water therein;

a hot water supply pipe connected to the hot water supply port, for discharging the hot water from the tank to the outside;

water supply means connected to the water supply port, for feeding water into the hot water tank; and bubble pump means arranged external of said hot water tank, for feeding hot water into the upper portion of the hot water tank after sucking the water from the lower portion of the inside of the tank and heating the sucked water, said pump means including a body defining a boiling chamber having upper and lower ends, heating means arranged around the pump means body, for heating water in the boiling chamber and generating steam bubbles in the water, a first connecting pipe for guiding the water from the lower portion in the hot water tank to the body, a first guide pipe arranged in the boiling chamber, for feeding the water, guided through the first connecting pipe, into the boiling chamber and condensing said steam bubbles, said first guide pipe having a lower end connected to the first connecting pipe and an upper end which opens into the boiling chamber and is located near the upper end of the boiling chamber, a second connecting pipe for guiding the water heated in the boiling chamber into the upper portion in the hot water tank, a second guide pipe arranged in the boiling chamber to surround the upper end portion of the first guide pipe and having a lower end opening into the boiling chamber, for guiding the water discharged from the upper end of the first guide pipe toward the lower end of the boiling chamber, first and second regulating means arranged in the first and second connecting pipes, for allowing the water to flow only from the lower portion of the hot water tank toward the upper portion thereof, said first and second guide pipes being arranged so that heat is exchanged between the water in the boiling chamber and the water flowing through the guide pipes, and said heating means being located between the lower end of the second guide pipe and the lower end of the boiling chamber to preheat the water prior to entry thereof into the boiling chamber.

21. The hot water boiling apparatus of claim 18 wherein said first guide pipe comprises means for feeding all of the water guided through the first connecting pipe into the boiling chamber.

* * * * *